United States Patent [19]

Thompson

[11] Patent Number: 4,546,703

[45] Date of Patent: Oct. 15, 1985

[54] CHARGE PLACEMENT DEVICE

[76] Inventor: Farish R. Thompson, Rte. 1, Afton, Wyo. 83110

[21] Appl. No.: 547,847

[22] Filed: Nov. 2, 1983

[51] Int. Cl.[4] ..... F42B 3/00

[52] U.S. Cl. ..... 102/333; 102/313; 102/317

[58] Field of Search ..... 102/312, 313, 317–333

[56] References Cited

U.S. PATENT DOCUMENTS

| | | | |
|---|---|---|---|
| 3,013,492 | 12/1961 | Sexton | 102/317 |
| 3,041,973 | 7/1962 | Sanders | 102/333 |
| 3,185,092 | 5/1965 | Hamilton | 102/317 |
| 3,208,381 | 9/1965 | Kihlstrom et al. | 102/333 |
| 3,285,173 | 11/1966 | Hamilton | 102/317 |
| 3,395,642 | 8/1968 | Foster et al. | 102/317 |
| 3,877,373 | 4/1975 | Bergmann et al. | 102/201 X |

FOREIGN PATENT DOCUMENTS

| | | | |
|---|---|---|---|
| 80405 | 10/1918 | Switzerland | 102/333 |

*Primary Examiner*—Peter A. Nelson
*Attorney, Agent, or Firm*—Roland H. Shubert

[57] ABSTRACT

A pre-packaged explosive charge of the type made up of modules having a threaded male coupling end and a threaded female coupling end is loaded into a bore hole by use of a plug fitting threadably attachable to the uppermost charge module. The fitting is constructed so that the torque required for disconnection of the fitting from the module is substantially less than the torque required to separate one module from another.

10 Claims, 2 Drawing Figures

CHARGE PLACEMENT DEVICE

BACKGROUND OF THE INVENTION

This invention relates to a device for loading explosives in a seismic shot hole and to a method for its use.

More particularly, this invention is directed to an insertion tool for use with loading pre-packaged explosives into an uncased seismic bore hole.

Seismic prospecting is typically carried out by drilling a hole or a pattern of holes to a pre-determined depth. An explosive charge is loaded into the hole and is detonated using electric blasting caps. Reflected and refracted sonic energy is sensed by a geophone array placed in a pattern on the ground surface around the shot hole. The geophones are connected to a recording truck where both oscillograph and magnetic tape recordings are made. Analysis of the records thus made provides information as to the subsurface structure.

Shot hole depth is typically about 100 feet although the depth can vary depending upon the thickness of the surface weathered layer. Diameter of the drilled holes is maintained as small as possible in the interests of rapid drilling rates at as low a cost as possible. Typical hole diameters range as small as three and five eights inches.

Pre-packaged explosives are routinely used in seismic exploration. An explosive charge is packaged within a container or shell usually fabricated of plastic. The shell is of cylindrical shape, is standardly either two and one quarter or two and one half inches in diameter containing five pounds of explosive. Individual shells are arranged with a threaded male and a threaded female end to allow assembly of multiple shells into a single charge of desired explosive weight. The weight of explosive used in a single seismic shot will vary according to conditions but typically will be on the order of fifty pounds requiring ten containers or shells to be assembled end to end. Length of an assembled charge of this weight is on the order of fifteen to twenty feet. One such explosive container in common commercial use is described in U.S. Pat. No. 3,185,092.

A seismic shot hole is loaded by assemblying an explosive charge, priming it with an electric blasting cap, and inserting the charge into the hole. Because of the relatively narrow clearances between the charge containers and the hole wall, it is seldom possible to simply lower the charge to the hole bottom. Often the hole is at least partially filled with mud and it is not unusual for the hole to partially cave. Frequently, the charge must be pushed through these obstructions in order to properly place it at the bottom of the hole. A series of wooden poles, called stinger poles, is used for this purpose. The poles are usually ten feet long and are connectable end to end.

Occasionally a hole is so badly obstructed, by caving or otherwise, that the charge cannot be forced to the hole bottom. If the obstruction is located at a point where the charge top is more than a few feet into the hole, there is essentially no way that the charge can be removed from the hole. The only connection to the charge at this point is the wire leads to the electric blasting cap. Attempting to pull the charge out with these leads would either break the leads or pull the cap from the charge.

It is not permissable to leave the live charge within the hole. Consequently, the only choice presently available is to detonate the charge. If the charge is stuck relatively near the top of the hole, detonation causes surface cratering which requires backfilling. In summary, a stuck charge usually results in loss of both the shot hole and the charge and occasionally results in surface cratering as well.

In spite of the fact that this problem has long been recognized, the industry has failed to provide a solution for it.

SUMMARY OF THE INVENTION

A fitting is provided for use in placing an explosive charge into and retrieving it from a drilled bore hole. The fitting is fixedly attached to the tamping end of a conventional stinger pole and comprises a threaded plug rotatably attachable to the female end of a pre-packaged explosive container or shell. The threads on the plug are provided with sufficient tolerance to allow rotatable disconnection from the explosive container without disturbing or loosening the juncture between interconnected explosive containers.

Hence, it is an object of this invention to provide a device for use with the loading of pre-packaged explosives into a bore hole.

Another object of this invention is to provide a method for the placement of pre-packaged explosives into a drilled hole and for the removal of the explosives in case of need.

Other objects of this invention will be apparent from the following description of certain preferred embodiments.

DESCRIPTION OF THE DRAWING

Certain embodiments of the invention are illustrated in the drawing in which.

DESCRIPTION AND DISCUSSION OF THE INVENTION

Figure 1:
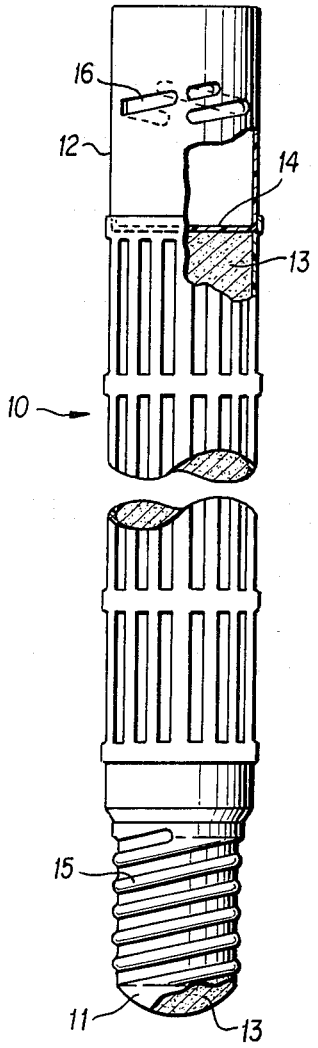
FIG. 1 is an elevation view in partial section of an explosives container of the type used in seismic prospecting.

The invention will be described in reference to the drawing in which a pre-packaged explosive module is shown at 10 of FIG. 1. Module 10 comprises an elongated cylindrical container having a male end 11 and a female end 12. The container is filled with an explosive 13 and is sealed by means of diaphram seal 14 disposed at the bottom of female end 12. The container and seal are typically fabricated from a moldable thermoplastic such as high density polyethylene.

Male module end 11 is provided with a double lead external thread 15. The female end 12 has double lead internal threads 16 compatible with the male module end. Any number of modules may be interconnected end to end to form a single explosive charge assembly. It is common practice to size the modules such that each contains approximately five pounds of explosive. A two and one-half inch diameter module containing five pounds of explosive is approximately twenty inches in length. A single cap is sufficient to detonate the entire charge assembly as the modules are so designed that, in an assembled position, the tip of male end 11 pressingly seats on diaphram seal 14 at the bottom of female end 12 thus ensuring that the detonation propogates from module to module.

As used in seismic exploration, as many as ten or more modules are interconnected to form a columnar charge. The charge is primed using an electric blasting cap and is inserted into a bore hole. Tamping rods or stinger poles are used to push the charge to the bottom of the hole. In this invention, the commonly used stinger pole is modified by attachment of a fitting thereto as is shown in FIG. 2.

Figure 2:
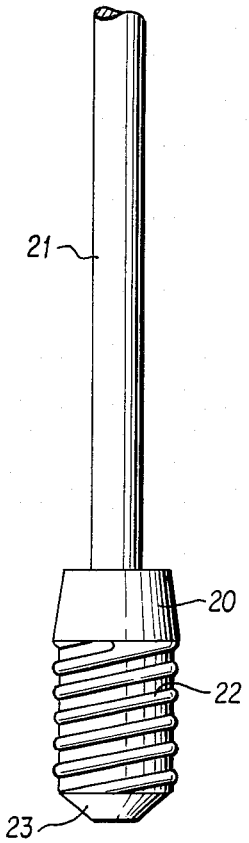
FIG. 2 is an elevation view of the device of this invention.

Turning now to FIG. 2, a plug member 20 is fixedly attached to the end of a tamping or stinger pole section 21. Plug 20 is provided with a double lead external thread 22 and is sized to threadably mate within the female end 12 of the explosive module. Tip 23 of plug 20 is preferably tapered with a blunt end so as not to damage the module diaphram 14 in the event that the plug is inserted far enough to bear upon the diaphram.

It is critical to this invention that the external threading 22 on the plug be formed with sufficient tolerance relative to the internal threading 16 of the female module end so that the disconnection torque between the plug and module is substantially less than is the torque required to separate one module from another. If this requirement is not met, then efforts to remove the plug from the explosive charge will result instead in a separation of the explosive charge at a juncture between modules.

Stinger pole section 21 is preferably of wood for safety considerations. It is fixedly attached to plug 20 at one end as by mechanical means or by adhesive bonding. The pole section may be of any convenient length, typically ten feet, and preferably has provision at the other end for connection to another pole section as is conventional.

Plug 20 must be fabricated of a non-sparking material, typically a plastic. It may be constructed by machining plastic rod stock of suitable diameter or it may be formed by casting techniques. A filled epoxy composition is suitable for use in forming the plug by casting.

A principal use of this invention is for the loading of explosive charges in uncased seismic boreholes. In this application, a columnar explosive charge of desired weight is formed by interconnecting a plurality, as many as ten or more, of explosive filled modules of the type shown for example in U.S. Pat. No. 3,185,092. The assembled charge is lowered into the bore hole and plug 20 is threadably attached within the female end of the uppermost module. The assembly is then lowered, or pushed, down the bore hole for the length of pole section 21. A second pole section is attached to the end of section 21 and the pushing or lowering process is repeated until the charge rests on the hole bottom. Plug 20 is then disconnected from the charge assembly by rotation of the stinger pole and is removed from the hole, successively disconnecting stinger pole sections.

Upon occasion, the explosive charge cannot be forced to the bottom of the hole. Such occurrences are ordinarily caused by spalling from the hole wall or by partial caving of the hole. In this event, use of the device of this invention allows retrieval of the charge from the hole simply by lifting the stinger pole sections up and out of the hole.

As has been set out before, it is conventional practice in the art to use a stinger pole with a blunt end tamp to push charges of this sort down a bore hole. Because there is no physical connection between the charge and the pole, it is not possible in conventional practice to retrieve a stuck charge from the hole. Consequently, a stuck charge not only results in loss of the charge but loss of the hole as well. Detonation of a charge stuck near the top of the hole will result in surface cratering necessitating additional renovation work.

It can now be appreciated that practice of this invention provides substantial advantage in the loading of bore holes, particularly seismic shot holes. It will be apparent to those skilled in the art that various modifications can be made without departing from the spirit and scope of the invention as disclosed and claimed.

I claim:

1. A device for placing an explosive charge into a bore hole, said explosive charge made up of a plurality of explosive filled modules, each module having a threaded male coupling portion at one end and a threaded female coupling portion at the other end, said device comprising:

a plug fitting having one end adapted for fixed connection to the end of a tamping pole, the other end of said plug fitting having external threads formed thereon, said fitting being sized to be rotatably attachable by insertion within the female end of the uppermost module of said explosive charge, said external threads formed with sufficient tolerance relative to internal threads of said female module end to ensure that the torque required for disconnection of said plug from said module end is substantially less than the torque required to separate one module from another.

2. The device of claim 1 wherein said plug fitting is fixedly attached to one end of a tamping pole.

3. The device of claim 2 wherein the other end of said tamping pole is adapted for connection to another pole section.

4. The device of claim 3 wherein both said plug fitting and said tamping pole are constructed of non-sparking material.

5. The device of claim 4 wherein said plug fitting is fabricated of plastic and said tamping pole is wood.

6. The device of claim 5 wherein said plug fitting is fabricated by machining plastic rod stock.

7. The device of claim 5 wherein said plug fitting is fabricated by casting a curable liquid plastic material in a mold.

8. The device of claim 1 wherein said plug fitting has double lead external threads formed thereon.

9. A method for placing a modular pre-packaged explosive charge into a bore hole comprising;

assembling a plurality of explosive filled modules of the type having a threaded male coupling at one end and a threaded female at the other end into a columnar explosive charge;

inserting said charge into a bore hole;

rotatably attaching to the female end of the uppermost charge module an externally threaded male plug fitting, said fitting fixedly attached to a tamping pole section and adapted to be disconnected from said module upon application of a rotational torque substantially less than that torque required to separate one module from another;

pushing said charge downward into the hole to the length of said pole section;

sequentially connecting additional pole sections and pushing said charge deeper into the hole until said charge rests on the hole bottom;

rotatably disconnecting said fitting from the explosive charge without loosening the juncture between adjacent modules of said charge, and removing said fitting from the hole.

10. The method of claim 9 wherein said bore hole is a seismic shot hole.

* * * * *